US006311520B1

(12) United States Patent
Alfano

(10) Patent No.: US 6,311,520 B1
(45) Date of Patent: Nov. 6, 2001

(54) PIERCED EAR JEWELRY

(76) Inventor: Brenda S. Alfano, 5603 Arboles, Houston, TX (US) 77035

( * ) Notice: Subject to any disclaimer, the term of this patent is extended or adjusted under 35 U.S.C. 154(b) by 0 days.

(21) Appl. No.: 09/154,649

(22) Filed: Sep. 17, 1998

(51) Int. Cl.[7] ..... A44C 7/00
(52) U.S. Cl. ..... 63/12; 63/13; 63/20; D11/40
(58) Field of Search ..... 63/12, 13, 20; 24/697.1, 710.7, 706.4, 710.5, 710.6; D11/40, 43, 44, 45, 48–78

(56) References Cited

U.S. PATENT DOCUMENTS

| | | | | |
|---|---|---|---|---|
| D. 334,905 | * | 4/1993 | Ritz | D11/43 |
| D. 348,023 | * | 6/1994 | Horner et al. | D11/43 |
| D. 376,768 | | 12/1996 | Ross | D11/41 |
| 2,205,918 | | 6/1940 | Bangs | 40/142 |
| 3,579,881 | * | 5/1971 | Cherry | 40/1.5 |
| 3,680,179 | * | 8/1972 | Saari | 24/106 |
| 3,953,910 | * | 5/1976 | Farb | 40/1.5 X |
| 4,141,453 | * | 2/1979 | Hanan | 211/163 |
| 4,218,894 | | 8/1980 | Tropea | 63/13 |
| 4,688,400 | | 8/1987 | Chioffe | 63/12 |
| 4,719,544 | * | 1/1988 | Smith | 362/104 |
| 4,854,132 | * | 8/1989 | Blumkin et al. | 63/12 |
| 5,044,176 | * | 9/1991 | King | 63/12 |
| 5,067,265 | * | 11/1991 | Harms | 24/703.1 X |
| 5,161,390 | * | 11/1992 | Sam | 63/12 |
| 5,289,700 | | 3/1994 | Cheng | 63/12 |
| 5,524,457 | * | 6/1996 | Dunham | 63/12 |
| 5,588,309 | | 12/1996 | Chioffe | 63/12 |

* cited by examiner

*Primary Examiner*—Anthony Knight
*Assistant Examiner*—Andrea Chop

(57) ABSTRACT

Ear jewelry, which allows wearers to utilize more than one ear pierce to attach the jewelry to the ear lobe, having a first ear pierce post and at least one moveably adjustable additional ear pierce post so that a wearer may place the posts in a desired position to accommodate the placement of their ear pierces. The present invention also provides for unique placement of jewelry on a wearer's ear by utilizing more than one ear pierce or by using a spring mechanism.

9 Claims, 7 Drawing Sheets

PIERCED EAR JEWELRY

BACKGROUND OF THE INVENTION

1. Field of the Invention

The present invention relates to jewelry and to methods of positioning jewelry. In another aspect, the present invention relates to ear jewelry and to methods of positioning ear jewelry on a wearer's ear. In even another aspect, the present invention relates to ear jewelry having a first ear pierce post and at least one additional ear pierce post and to methods of positioning such ear jewelry on a wearer's ear. In still another aspect, the present invention relates to ear jewelry, having a first ear pierce post and at least one additional ear pierce post, where at least one ear pierce post is moveably adjustable and to methods of positioning such ear jewelry on a wearer's ear.

2. Description of the Related Art

Earrings to be used with pierced earlobes typically include an ornament affixed to one end of a post and a clutch member adapted to frictionally engage the other end of the post after it has been inserted through a wearer's single ear pierce so as to secure the jewelry onto the ear of the wearer.

Part of the decorative effect of ear jewelry is the placement of the jewelry on the wearer's earlobe. In recent years, multiple piercing, for the insertion of several earrings into one's ear lobe, has becoming increasingly popular.

There have been several attempts in the prior art to provide for articles of ear jewelry.

U.S. Pat. No. 2,205,918 issued Jun. 25, 1940 to Bangs discloses an article of jewelry which comprises a frame member which is provided with one or more longitudinal slots. The frame of the '918 device is made of suitable resilient metal or other resilient material so as to provide resilient bars whose edges define the slot or slots separated by cross portions of the frame. Decorative characters having brackets provided with a laterally extending arm with an enlarged head which includes spaced head portions forming a groove are attached to the frame of the '918 device by springing the resilient material of the frame into the groove.

U.S. Pat. No. 4,218,894 issued Aug. 26, 1980 to Tropea discloses an earring specially adapted for pierced ears. Apart from the normal ornament, post and retaining clutch, the earring of the '894 patent includes a secondary ornament mounted to be both rotatable with respect to its mounting means and adjustably slidable towards and away from the first ornament so as to be positionable below the wearer's earlobe. Such is accomplished in '894 device by the provision of a secondary clutch attached to the primary clutch and in which a post portion of the secondary ornament is rotatably and slidably secured.

U.S. Pat. No. 4,688,400 issued Aug. 25, 1987 to Chioffe discloses an earring back device consisting of a back clutch movably attached to a bride mechanism whose ends are inserted into an ornament holder. The ends of the bridge mechanism of the '400 earring are inserted through two peripheral channels in the back clutch enabling the clutch to be moved up and down on the bridge mechanism to adjust the distance between the back clutch and the ornament holder so that a wearer may place the ornament holder in a desired position at the base of the ear lobe.

U.S. Pat. No. 5,289,700 issued Mar. 1, 1994 to Cheng discloses an earring for pierced ears including a post that is slidably mounted in a vertical slot on the main body or frame of the earring so that the main frame, and the ornamentation carried thereon, can be adjusted upwardly or downwardly in reference to the earlobe and the post projecting therethrough.

U.S. Pat. No. Des. 376,786 issued Dec. 24, 1996 to Ross discloses an ornamental design for a dual hole earing.

U.S. Pat. No. 5,588,309 issued Dec. 31, 1996 to Chioffe discloses a device including a conventional ornament holder with a friction post which is connected to a conventional back clutch. Attached to the back clutch of the '309 device is a clutch adapter, which is designed to move along a bridge mechanism that is composed of a bent spring wire. At the other end of the spring wire, a base is provided to which a second ornament holder may be affixed.

There is still a need in the art for new and improved ear jewelry.

There is another need in the art for fashionable and aesthetically pleasing ear jewelry.

There is another need in the art for new methods of positioning ear jewelry.

There is even another need in the art for ear jewelry with adjustable posts which may utilize multiple ear pierces to position the jewelry on a wearer's ear.

These and other needs in the art will become apparent to those of skill in the art upon review of this specification, including its drawings and claims.

SUMMARY OF THE INVENTION

It is an object of the present invention to provide new and improved ear jewelry.

It is another object of the present invention to provide for fashionable and aesthetically pleasing ear jewelry.

It is even another object of the present invention to provide for new methods of positioning ear jewelry.

It is still another object of the present invention to provide for ear jewelry with adjustable ear pierce posts which may utilize multiple ear pierces to position the jewelry on a wearer's ear.

These and other objects of the present invention will become apparent to those of skill in the art upon review of this specification, including its drawings and claims.

In one embodiment of the present invention there is provided an article of jewelry which includes a first ear pierce post attached to a decorative item, and a second ear pierce post moveably attached to the decorative item such that a wearer may select the position of the second post to correspond to the placement of their second ear pierce.

In another embodiment of the present invention there is provided a method for positioning a decorative item on a wearer's ear which includes the steps of inserting a first ear pierce post through a first ear pierce, adjusting the position of the second ear pierce post to correspond to a second ear pierce, inserting the second ear pierce post through the second ear pierce, and then attaching a clutch member to each ear pierce post.

In even another embodiment of the present invention there is provided an article of jewelry including an ear pierce post attached to a decorative item and a positioning arm attached to the clutch member, where the positioning arm provides sufficient tension to position the decorative item on a wearer's ear.

These and other embodiments of the present invention will become apparent to those of skill in the art upon review of this specification, including its drawings and claims.

DETAILED DESCRIPTION OF THE INVENTION

The present invention provides ear jewelry which allows a wearer to utilize more than one ear pierce to attach the jewelry to the ear lobe. As no two people will have multiple ear pierces in the same locations, the present invention allows a wearer to insert one post in a first ear pierce, then adjust the placement of a second post to correspond to the unique placement of that person's second ear pierce. The present invention also provides for unique placement of jewelry on a wearer's ear that is accomplished by either utilizing more than one ear pierce or by using a positioning arm. Referring now to the figures, the jewelry of the present invention will be shown and described in detail.

Figure 1:
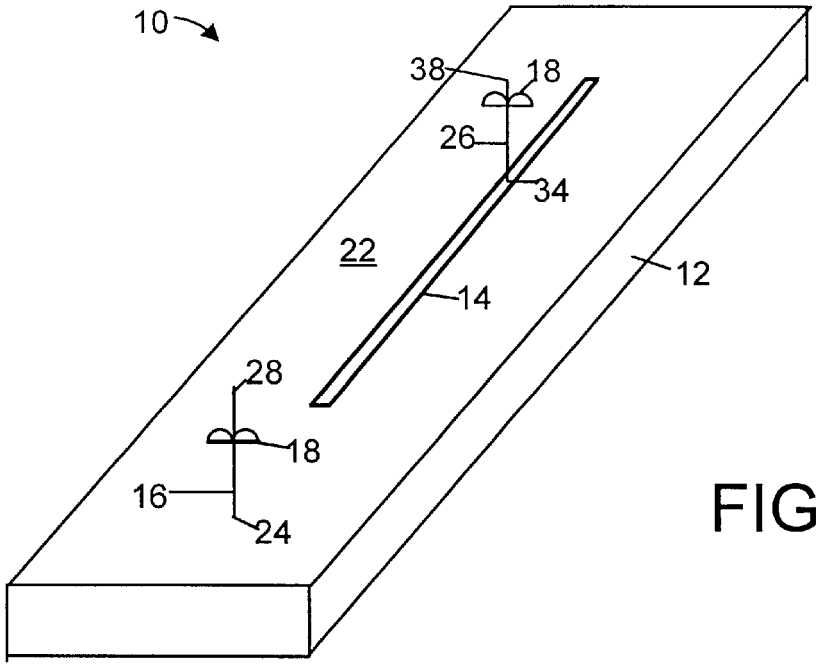
FIG. 1 is a perspective view of one embodiment of ear jewelry 10 having decorative member 12, channel 14, first ear post 16, second ear post 26 and clutch members 18.

FIG. 1, is a perspective view of one embodiment of the ear jewelry, shown generally as 10, of the present invention. Ear jewelry 10 generally includes decorative member 12, track or channel 14, first ear post 16, second ear post 26 and clutch members 18.

Decorative member 12 may be an ornament of any design, shape, or size such as to provide for a fashionable or aesthetically pleasing look. Although decorative member 12 is shown in the figures to be a bar shape, it is understood that present invention is not so limited. Decorative member 12 may be made of any material desired to produce a fashionable or aesthetically pleasing look. Non-limiting examples of suitable materials include metal, metal alloy, plastic, ceramic, wood or combinations thereof.

First ear post 16 may be any post as is known in the art suitable to pass through the pierced opening of a wearer's earlobe. In the embodiments shown in FIGS. 1 and 2, one end 24 of first ear post 16 is fixedly attached to the back 22 of decorative member 12 by any suitable means. Non-limiting examples of suitable means to affix ear pierce post 16 include soldering, gluing, screwing or a combination thereof. It is also understood that first ear post 16 may be integral with decorative item 12. Second end 28 of ear pierce post 16 is adapted to be received by clutch member 18 behind the earlobe of the wearing. Ear pierce post 16 may be made of any suitable material. Preferably, ear pierce post 16 is made of a metal or metal alloy.

Second ear post 26 may be also any post as is known in the art suitable to pass through the pierced opening of a wearer's earlobe. In the embodiments shown in FIGS. 1 and 2, one end 34 of second ear post 26 is positioned in channel 14 which is defined by the back 22 of decorative member 12 such that post 26 may travel the length of channel 14. Second end 38 of ear post 26 is adapted to be received by clutch member 18 behind the earlobe of the wearing. Ear pierce post 26 may be made of any suitable material. Preferably, ear pierce post 26 is made of a metal or metal alloy.

Figure 3:
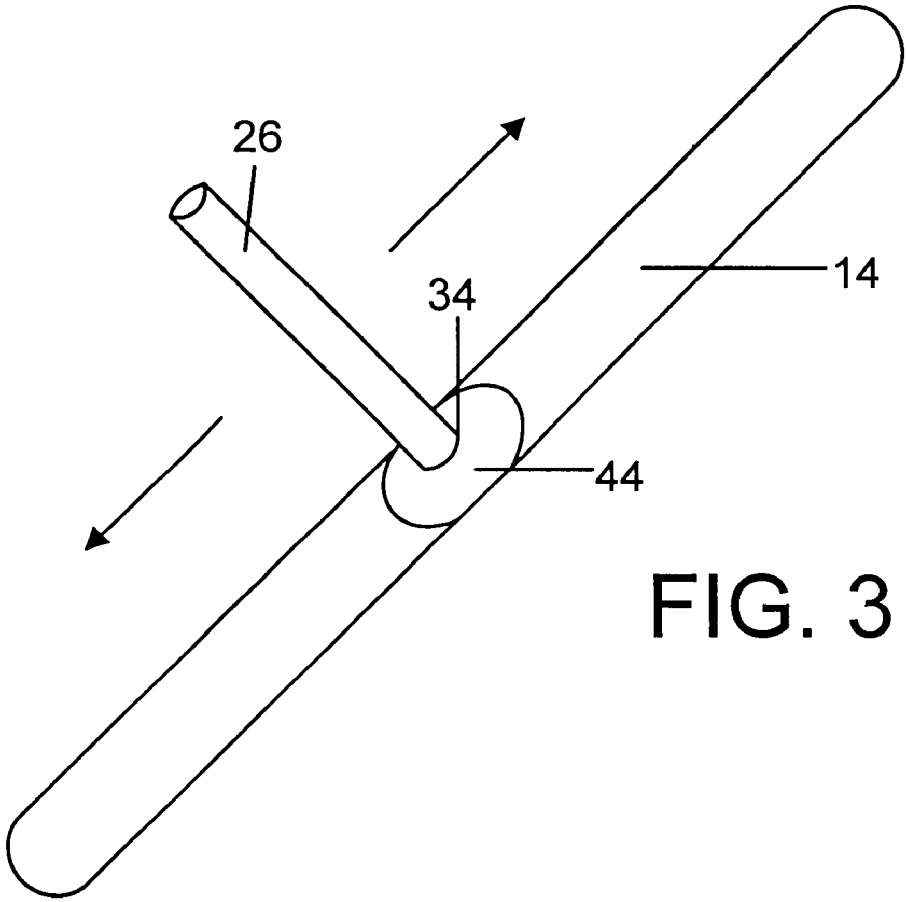
FIG. 3 is a an enlarged view of post 26 of FIG. 1 with end 34 including an oversized portion 44 positioned in channel 14.

Ear pierce Post 26 is moveably attached to or slidably engaged with decorative member 12 by placement into channel 14 by any suitable means such that post 26 may traverse the length of track or channel 14. Referring now additionally to FIG. 3, there is shown an enlarged view of one example of how post 26 may be positioned in channel 14. In FIG. 3, end 34 of post 26 includes oversized portion 44. Oversized portion 44 is partially enclosed by channel 14 such that post 26 is not readily removed from channel 14 but may traverse its length. To partially enclose oversized portion 44 in this manner, channel 14, may be undercut to accommodate oversized portion 44.

Figure 2:
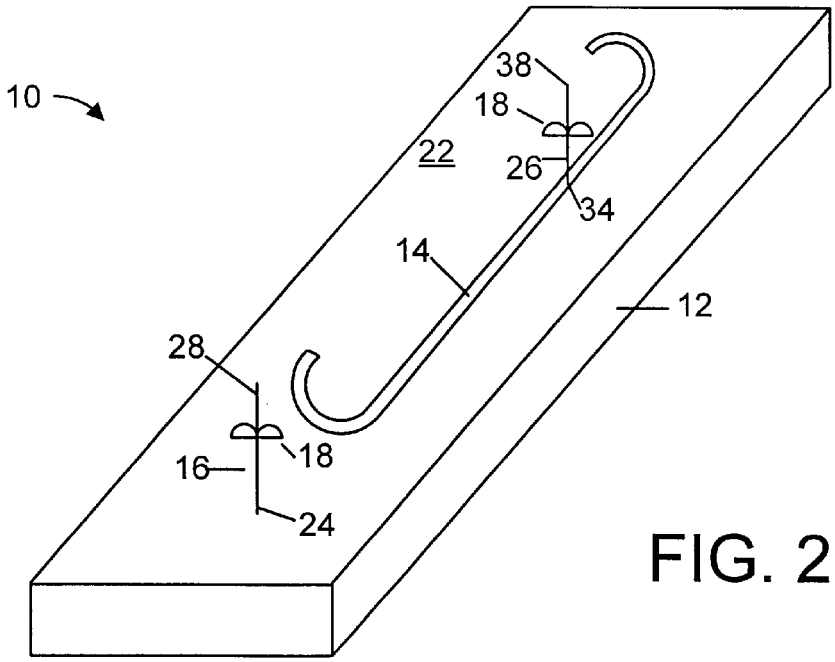
FIG. 2 is a perspective of ear jewelry 10 of FIG. 1 illustrating an alternate shape for channel 14.
Figure 4:
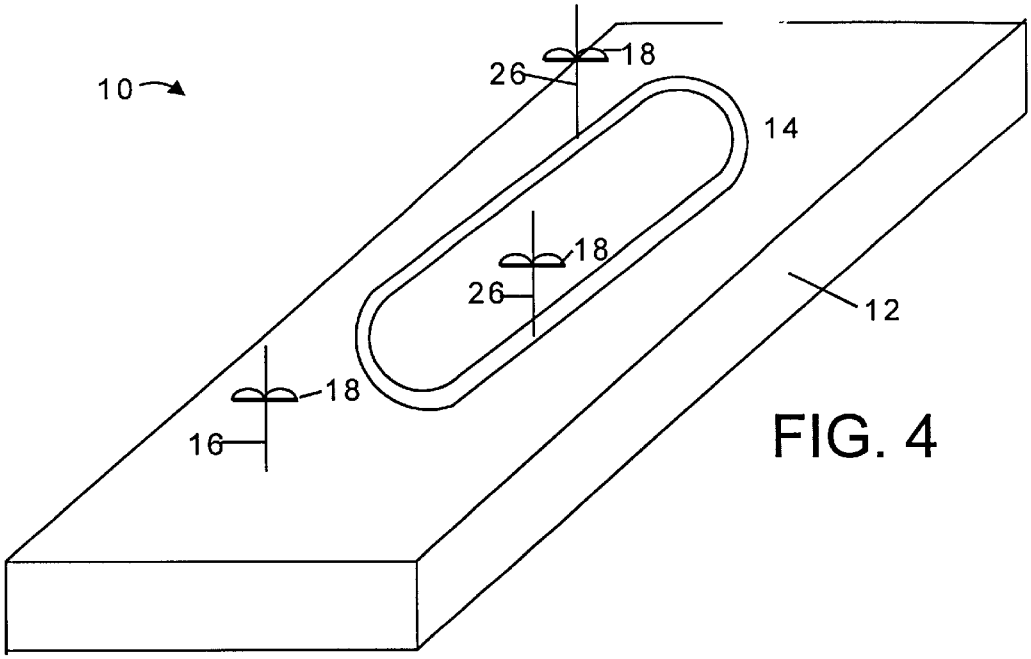
FIG. 4 is an illustration of ear jewelry 10 showing channel 14 as oval or circular.
Figure 5:
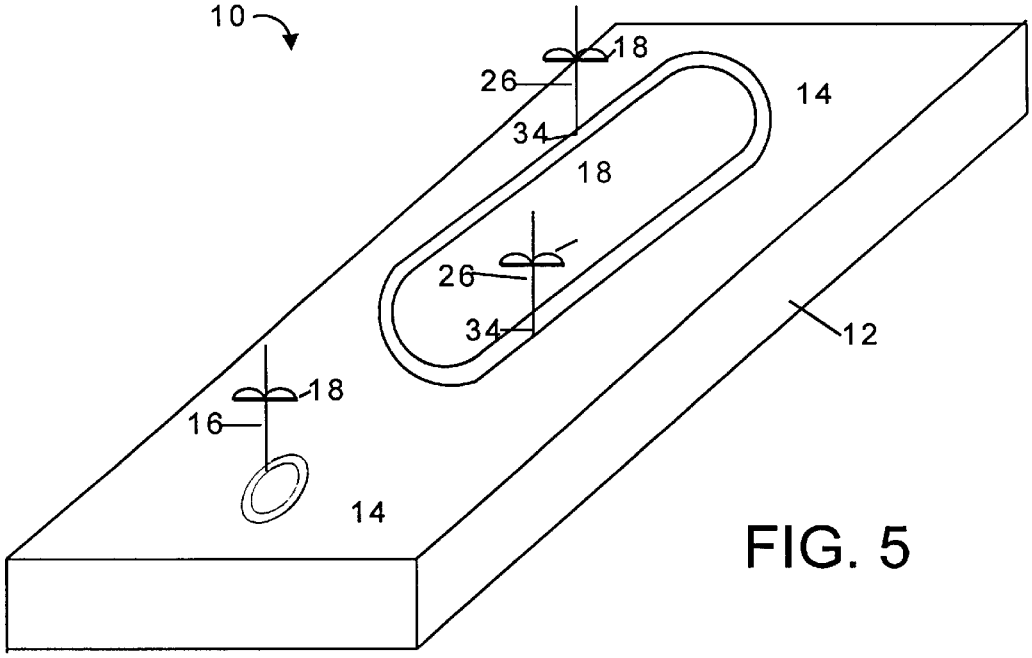
FIG. 5 is an illustration of ear jewelry 10 showing decorative member 12 containing more than one channel or track 14 to accommodate any number of slidably positionable posts 26.
Figure 8:
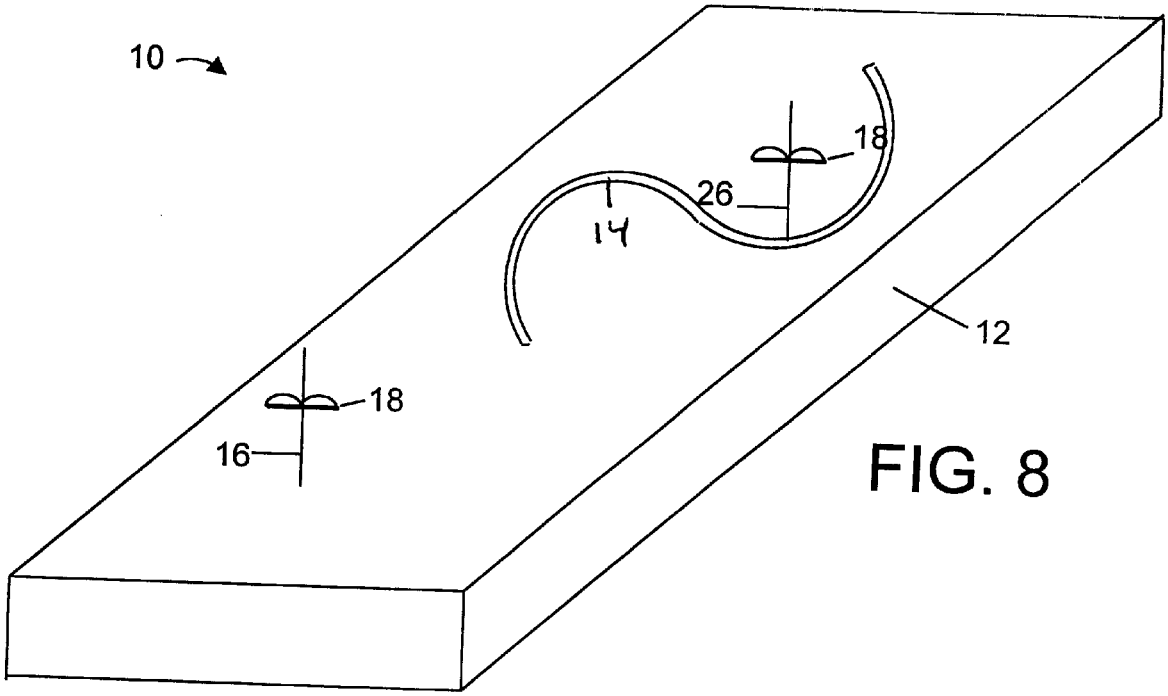
FIG. 8 is an illustration of ear jewelry 10 showing channel 14 as S-shaped.

Referring now additionally to FIGS. 4 and 5, channel 14 may be any shape suitable to position one or more ear pierce posts along its length such that a individual may position multiple ear pierce posts to correspond with the unique placement of their particular ear pierces. For example, as shown in FIG. 1, channel 14 may be straight or, as shown in FIG. 2, channel 14 may be curved. In addition, as shown in FIGS. 4 and 5, channel 14 may be oval or circular. Channel 14 may also be semicircular or S-shaped, as shown in FIG. 8. While channel 14 is shown to be roughly centered on decorative item 12, it is understood that the placement of channel 14 on decorative item 12 may be made such to locate the ear pierce posts in position to accommodate multiple ear pierces and to place decorative item 12 on the wearer's ear in a desired fashionable or aesthetically pleasing manner.

As shown in FIG. 5, decorative member 12 may contain more than one channel or track 14 to accommodate any number of slidably positionable posts 26. It should be understood that any desired number of slidably adjustable posts 26 may be utilized in any number of channels 14 such that a wearer may adjust the placement of the posts 26 to correspond the desired number of ear pierces in order to attach and position decorative item 12 on the wearer's ear.

Figure 6A:
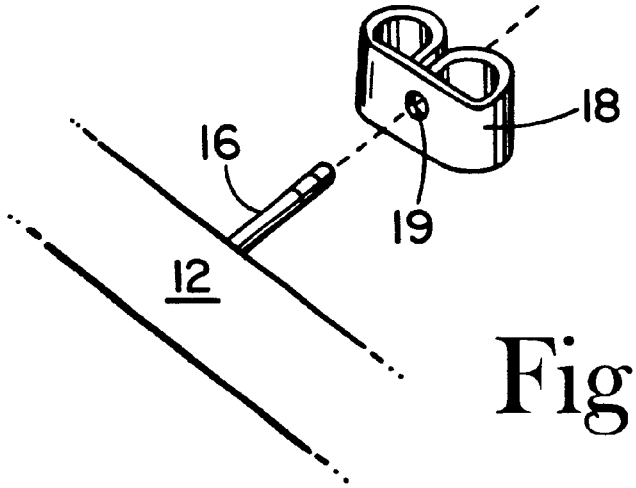
FIG. 6A is an illustration of a friction back clutch member 18 having opening 19.
Figure 6B:
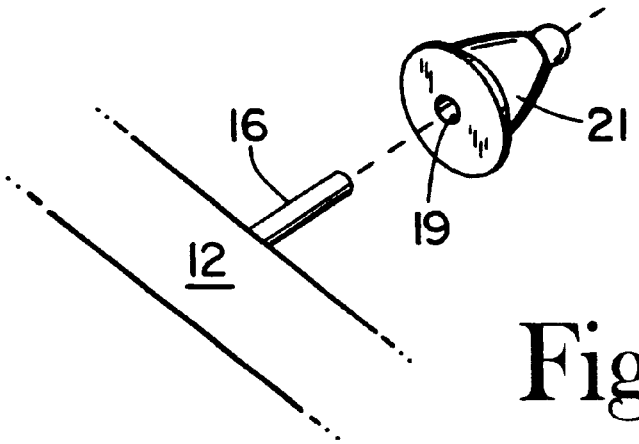
FIG. 6B is an illustration a disk back clutch member 21 having opening 19.

Referring now to FIGS. 6A and 6B clutch member 18 may be any member as is known in the art suitable to engage ear post 16 and 26 to secure ear jewelry 10 to a wearer's ear. Non-limiting examples of suitable clutch member 18 include friction back clutch 18, disk back clutch 21 or screw on back clutch members. FIG. 6A, for example, is an illustration of a friction back clutch 18 while FIG. 6B, is an illustration a disk back clutch 21.

Figure 9:
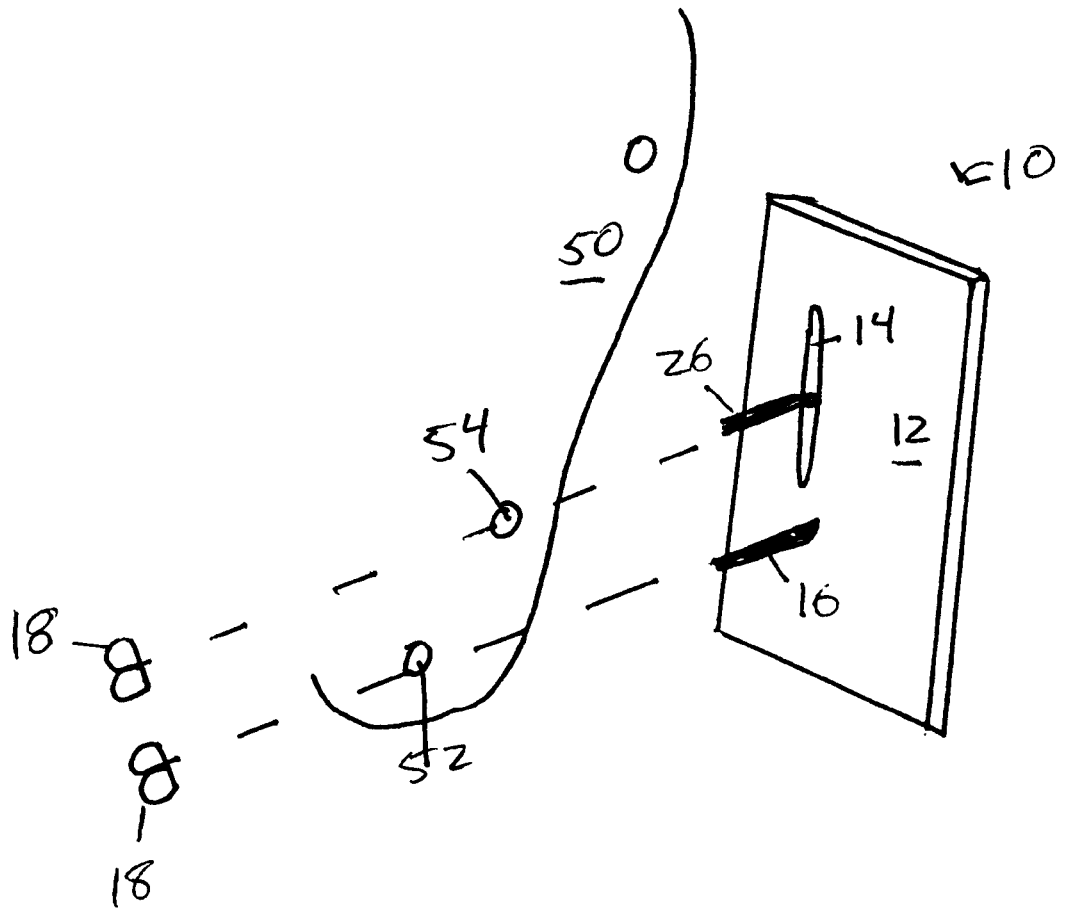
FIG. 9 is an exploded perspective view of how ear jewelry 10 is worn on ear 50.

Referring now to FIG. 9, in securing decorative item 12 to a wearer's ear post 16 is first inserted through a wearer's ear 50, pierce 52 then inserted into opening 19 of clutch member 18 which is further provided with a means for frictionally engaging post 16. Friction back clutch 18 of FIG. 6A permits the frictional placement on and removal from post 16 by way of friction between post 16 and opening 19. Disk back clutch 21 of FIG. 6B permits the frictional placement on and removal from post 16 by way a friction holding material lining the inside of opening 19. Non-limiting examples of friction holding materials include TEFLON, plastic or rubber.

Post 26 is then positioned along channel 14 such that the placement of post 26 corresponds to a wearer's second ear piece 54. Post 26 is inserted through the second ear piece then inserted into opening 19 of clutch member 18 which engages post 26 in the same manner as it engages post 16 as described above. Optionally, as shown in FIGS. 4 and 5 more than one slidably adjustable posts 26 may positioned into channel 14 to correspond with a wearer's second and third ear pierce.

Figure 7:
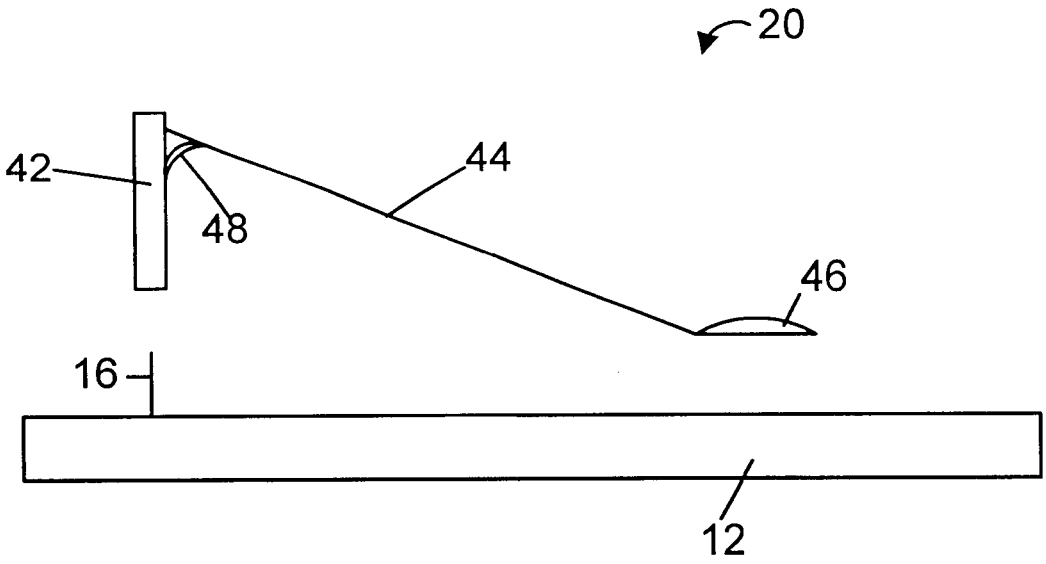
FIG. 7 is an illustration of a second embodiment of ear jewelry 20 including positioning arm 44, having clutch member 42.

Referring now to FIG. 7 another embodiment, shown generally as 20, of the present invention is illustrated. Should a wearer wish to have the fashion look of the present invention without resorting to the addition of at least a second ear pierce, the second embodiment may be used to position the jewelry on a wearer's ear as if at least one additional ear pierce were being utilized. In the embodiment shown in FIG. 7, decorative item 12 contains a fixed ear pierce post 16 as described above. Ear post 16 is first inserted through a wearer's ear pierce then inserted into clutch member 42 which is further provided with a means for frictionally engaging post 16. Attached to clutch member 42 is positioning arm 44 which includes area 46 for contacting the back of the wearer's ear. Positioning arm 44 provides enough tension to area 46 to position decorative item 12 onto a wearer's ear in a manner similar to if more than one ear pierce is utilizes. To provide further tension to area 46, positioning arm 44 may further be provided with a reinforcing member 48.

Positioning arm 42 and area 46 may be made of any material suitable to provide enough tension to area 46 to hold decorative item 12 onto a wearer's ear. Non-limiting examples of suitable materials include metal, metal alloys, plastic or a combination thereof. Optionally, area 46 may be padded or covered to provide comfort to the wearer.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

I claim:

1. A method for positioning a decorative item on a wearer's ear, wherein the decorative item has a front surface, a back surface, a first ear pierce post attached to the back surface and a second ear pierce post moveably attached to the back surface, where the ear defines a first ear pierce and a second ear pierce, the method comprising:

a) inserting the first ear pierce post through the first ear pierce;

b) adjusting the position of the second ear pierce post to correspond to the position of the second ear pierce;

c) inserting the second ear pierce post through the second ear pierce; and d) attaching a clutch member to each pierce post.

2. The method of claim 1 wherein the first end of the second ear pierce post is positioned in a channel defined by the decorative item such that the second ear pierce post may travel the length of the channel.

3. The method of claim 2 wherein the channel has a shape selected from the group consisting of straight, curved, semicircular, S-shaped, oval and circular.

4. The method of claim 1 wherein the first end of the first ear pierce post is moveably attached to the decorative item.

5. A decorative ear jewelry piece comprising:

(a) a decorative pierced-ear member having a front and rear surface;

(b) a plurality of ear pierce posts attached to the rear surface of the decorative pierced ear member, each post having an end adapted for passing through a hole pierced in a human ear, and for receiving a clutch to secure the post to the pierced ear;

(c) the opposite end of all but one of the posts being attached to the rear surface of the pierced-ear member, in a fixed relationship thereto;

(d) the opposite end of the one post being movably attached to the rear surface of the pierced-ear member.

6. The decorative ear jewelry piece of claim 5 wherein the rear surface of the member has located thereon a channel, and the opposite end of the one post is positioned in the channel such that the one post is movable within the channel throughout the length of the channel.

7. The decorative ear jewelry piece of claim 5, wherein the decorative pierced-ear member is metal.

8. A decorative ear jewelry piece comprising:

(a) a decorative pierced-ear member having a front and rear surface;

(b) a plurality of ear posts, each post having an end adapted for passing through a hole pierced in a human ear, and for receiving a clutch to secure the post to the pierced ear and each post having its opposite end attached to the rear surface of the decorative pierced ear member;

(c) with at least two of said ear posts attached to the rear surface being movably attached thereto.

9. The decorative ear jewelry piece of claim 8, wherein the rear surface of the member has located thereon at least one channel, and the said opposite end of each of the two posts are positioned in the at least one channel such that the posts are moveable within the at least one channel throughout the length of the channel.

* * * * *